United States Patent [19]

Perfetti et al.

[11] Patent Number: 4,941,485

[45] Date of Patent: Jul. 17, 1990

[54] CIGARETTE

[75] Inventors: Patricia F. Perfetti, Winston-Salem; Gary R. Andersen, Clemmons, both of N.C.

[73] Assignee: R. J. Reynolds Tobacco Company, Winston-Salem, N.C.

[21] Appl. No.: 339,933

[22] Filed: Apr. 18, 1989

[51] Int. Cl.[5] ..... A24D 4/02

[52] U.S. Cl. ..... 131/365; 131/336

[58] Field of Search ..... 131/365, 336, 358

[56] References Cited

U.S. PATENT DOCUMENTS

| | | | |
|---|---|---|---|
| 1,879,128 | 9/1932 | Desper . | |
| 2,171,986 | 9/1939 | Poetschke | 131/36 |
| 2,886,041 | 5/1959 | Harwood | 131/15 |
| 2,886,042 | 5/1959 | Hoover | 131/15 |
| 2,992,647 | 7/1961 | Figge | 131/9 |
| 3,030,963 | 4/1962 | Cohn | 131/4 |
| 3,044,924 | 7/1962 | Schur | 162/139 |
| 3,640,285 | 2/1972 | Briskin et al. | 131/2 |
| 3,667,479 | 6/1972 | Sanford et al. | 131/15 |
| 3,699,972 | 10/1972 | Frisch | 131/9 |
| 3,722,515 | 3/1973 | Reynolds | 131/15 B |
| 3,797,504 | 3/1974 | Hughes et al. | 131/15 B |
| 3,908,671 | 9/1975 | Cogbill, II | 131/15 R |
| 4,044,778 | 8/1977 | Cohn | 131/4 A |
| 4,129,134 | 12/1978 | Hind et al. | 131/2 |
| 4,230,131 | 10/1980 | Simon | 131/4 A |
| 4,231,377 | 11/1980 | Cline et al. | 131/9 |
| 4,420,002 | 12/1983 | Cline | 131/334 |
| 4,433,697 | 2/1984 | Cline et al. | 131/365 |
| 4,450,847 | 5/1984 | Owens | 131/365 |
| 4,453,553 | 6/1984 | Cohn . | |
| 4,461,311 | 7/1984 | Mathews et al. | 131/365 |
| 4,622,983 | 11/1986 | Mathews et al. | 131/365 |
| 4,805,644 | 2/1989 | Hampl, Jr. et al. | 131/365 |

FOREIGN PATENT DOCUMENTS

| | | |
|---|---|---|
| 290911 | 11/1988 | European Pat. Off. . |
| 249932 | 5/1969 | U.S.S.R. . |
| 249933 | 5/1969 | U.S.S.R. . |

OTHER PUBLICATIONS

*Bumazhnaya Promyshennost* (Paper Industry) No. 12, Dec., 1970, Timolovskaya et al.

*Primary Examiner*—V. Millin
*Assistant Examiner*—J. L. Doyle

[57] ABSTRACT

Cigarettes which yield low levels of visible sidestream smoke upon use employ a paper wrapping material having about 25 weight percent magnesium hydroxide, about 15 weight percent calcium carbonate and about 60 weight percent flax. The wrapping material has an inherent permeability of about 12 CORESTA units and a net permeability of about 100 to about 130 CORESTA units. The wrapping material containing an amount of water soluble alkali metal salt and water soluble alkali earth metal salt sufficient to provide at least about 20 mg water soluble alkali metal and alkali earth metal ions per gram of dry base web. The cigarettes, when employed, provide cohesive ash which is not highly flakey.

30 Claims, 1 Drawing Sheet

CIGARETTE

BACKGROUND OF THE INVENTION

The present invention relates to smoking articles such as cigarettes, and in particular to cigarettes which generate low amounts of visible sidestream smoke.

Popular smoking articles such as cigarettes have a substantially cylindrical rod shaped structure and include a charge of smokable material such as shredded tobacco (e.g., cut filler) surrounded by a paper wrapper thereby forming a so-called "tobacco rod." It has become desirable to manufacture cigarettes having cylindrical filter elements aligned in an end-to-end relationship with the tobacco rod. Typically, filter elements are manufactured from fibrous materials such as cellulose acetate and plug wrap, and are attached to the tobacco rod using a circumscribing tipping material.

Cigarettes are employed by the user by burning one end thereof. The user then receives mainstream smoke into his/her mouth by drawing on the opposite end (e.g., the filter end) of the cigarette. During the time that the cigarette is not being drawn upon by the user, it remains burning, and sidestream smoke is generated. Sidestream smoke is smoke which directly enters the atmosphere during the static burn period of a smoking article. Sidestream smoke diffuses into the atmosphere, and the characteristic visible nature thereof may be perceived negatively by certain individuals. Thus, certain consumers of cigarettes have indicated a desire to decrease the levels of visible sidestream smoke generated by their cigarette.

Cigarette paper wrappers for the preparation of tobacco rods are set forth in U.S. Pat. Nos. 4,231,377 to Cline et al, 4,420,002 to Cline, 4,461,311 to Mathews et al, 4,450,847 to Owens, and 4,805,644 to Hampl, Jr. et al. The paper wrappers proposed in the foregoing patents have a propensity to provide cigarettes which generate relatively low levels of visible sidestream smoke. A cigarette which generates relatively low levels of visible sidestream smoke is set forth in European Patent Application No. 290911. However, cigarette paper wrappers which are useful for manufacturing cigarettes which generate low amounts of visible sidestream smoke upon use, particularly those wrappers which include magnesium hydroxide as a filler component, often have the propensity to provide, upon use, an ash having flakey properties.

It would be desirable to provide a cigarette which incorporates a paper wrapper such that upon use (i) the cigarette generates low levels of visible sidestream smoke, and (ii) the ash of the paper wrapper is fairly cohesive and not highly flakey.

SUMMARY OF THE INVENTION

The present invention relates to cigarettes having a rod of smokable material contained in a circumscribing paper wrapper. The paper wrapper includes a cellulosic base web and a water insoluble inorganic filler. The preferred cellulosic material is flax fibers, and the preferred inorganic filler is a mixture of calcium carbonate and magnesium hydroxide. The paper wrapper also includes at least one water soluble alkali metal salt and at least one water soluble alkali earth metal salt. The total amount of water soluble alkali metal salt and water soluble alkali earth metal salt is sufficient to provide at least 20 mg water soluble alkali metal and alkali earth metal ions per gram of dry base web. As used herein, the term "water soluble alkali metal and alkali earth metal ions" in reference to the incorporation of those ions within the paper wrapper means that those ions incorporated into the paper are provided into the paper in the form of water soluble salts as opposed to water insoluble filler materials.

Preferred cigarettes of the present invention, when employed, yield low levels of visible sidestream smoke. In particular, cigarettes of the present invention, which incorporate paper wrappers for the tobacco rod employing magnesium hydroxide filler, have improved ash properties over similar cigarettes which incorporate similar paper wrappers but having water soluble alkali metal and alkali earth metal salts sufficient to provide less than 20 mg of alkali metal and alkali earth metal ions per gram of dry base web. An improved ash is an ash which is cohesive and exhibits good integrity, and which is not highly flakey. In addition, the use of mixtures of water soluble metal ions at relatively high levels in the paper wrappers of preferred cigarettes of the present invention can provide for sidestream and mainstream smoke which does not possess a significant off-aroma or off-taste due to a relatively high level of a single metal ion.

DETAILED DESCRIPTION OF THE PREFERRED EMBODIMENTS

Figure 1:
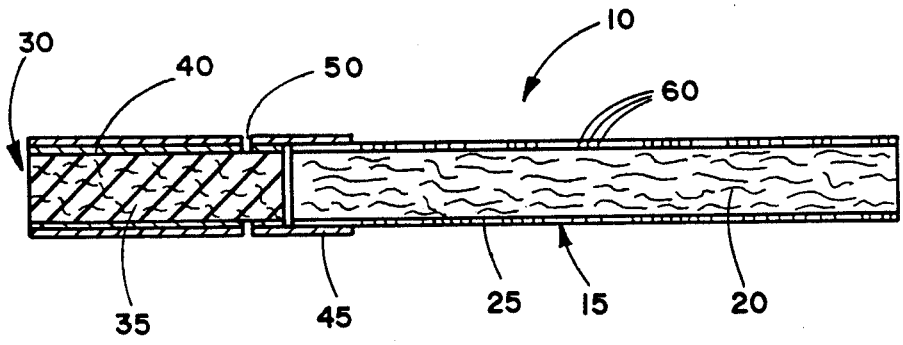
FIG. 1 is a longitudinal sectional view of a cigarette of this invention.

One embodiment of a cigarette 10 of this invention is shown in FIG. 1. The cigarette includes a generally cylindrical rod 15 of a charge or roll of smokable filler material 20 contained in circumscribing wrapping material 25. The rod 15 is conveniently referred to as a "smokable rod" or a "tobacco rod.") The ends of the tobacco rod are open to expose the smokable filler material.

The cigarette 10 normally includes a filter element 30 or other suitable mouthpiece positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough. The filter element 30 includes filter material 35 which is overwrapped along the longitudinally extending surface thereof with circumscribing plug wrap material 40.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the plug wrap 40 and the outer surface of the wrapping material 25 of the tobacco rod, using a suitable adhesive. A ventilated or air diluted smoking article is provided with an air dilution means such as a series of perforations 50 each of which extend through the tipping material and plug wrap.

Figure 2:
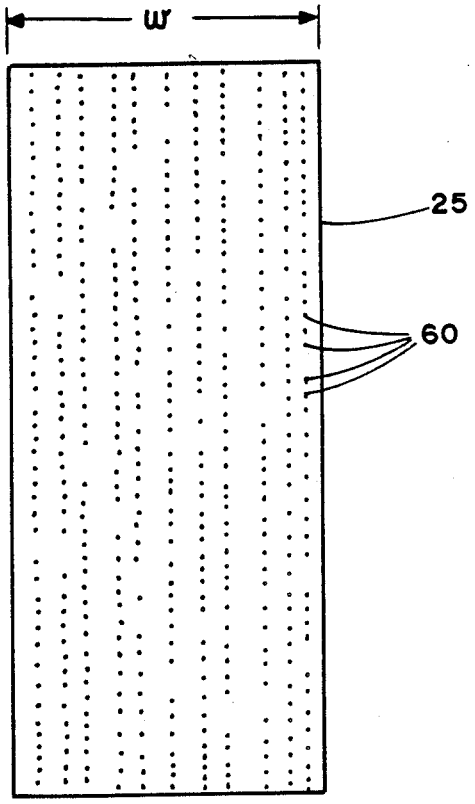
FIG. 2 is a diagrammatic illustration of the type of wrapping material which can be employed to provide the smokable rod of a cigarette of this invention.

Referring to FIGS. 1 and 2, the wrapping material 25 has a width w (shown in FIG. 2) which is equal to the circumference of the cigarette plus the lap zone of the glue line which ultimately results during cigarette manufacture. The preferred wrapping material 25 includes a series of perforations 60 which extend in a linear fashion along the longitudinal length of thereof. Alternatively, other configurations such as a random perforation pattern can be provided. The size, number and relative positioning of the individual perforations 60 can vary depending upon the desired characteristics of the cigarette which has the wrapping material incorporated therein. The individual perforations are shown as enlarged in FIGS. 1 and 2.

Typically, the tobacco rod has a length which ranges from about 50 mm to about 85 mm, and a circumference of about 16 mm to about 28 mm. The tobacco rods and the resulting cigarettes can be manufactured in any known configuration using known cigarette making techniques and equipment.

Typically, the filter element has a length which ranges from about 20 mm to about 35 mm and a circumference of about 16 mm to about 28 mm. The filter material can be any suitable material such as cellulose acetate, polypropylene, tobacco material, or the like. The plug wrap typically is a conventional paper plug wrap, and can be either air permeable or essentially air impermeable. However, if desired, a nonwrapped cellulose acetate filter element can be employed. The various filter elements suitable for use in this invention can be manufactured using known cigarette filter making techniques and equipment.

Filter elements most preferably provide minimal mainstream smoke removal efficiencies while maintaining the desirable draw characteristics of the cigarette. Such minimal smoke removal efficiencies are provided by the so-called "low efficiency" filters. Low efficiency filters have a minimal ability to remove mainstream smoke particulates. Generally, low efficiency filters provide about 40 weight percent mainstream smoke particulate removal efficiency or less. The low efficiency filter is desirably used herein in order that the relatively low "tar" yield is obtained primarily as a result of a relatively high level of filter ventilation or air dilution. Such cigarette configurations provide a means for reducing the yields of mainstream gaseous components. An example of a suitable material for providing a low efficiency filter element is a cellulose acetate tow item having about 8 denier per filament and about 40,000 total denier.

Alternatively, the cigarette can have a mouthpiece equipped with means for providing air dilution to the mainstream smoke. The mouthpiece can be a simple hollow tube of paper or plastic (e.g., polyethylene, or the like) to which the air dilution can be provided by the addition of holes, slits, or the like. Such a mouthpiece can provide high levels of air dilution to the mainstream smoke without filtration of the smoke by a filter material such as cellulose acetate.

The filler material employed in the manufacture of the smokable rod can vary. However, it is preferable to provide a smokable rod of relatively low packing density. Normally, the majority of the smokable filler material present in the smokable rod is flue-cured tobacco material of some form. The flue-cured tobacco material can be blended with other tobacco materials, such as the Oriental tobaccos; as well as tobacco substitute materials. For example, puffed grains such as puffed milos, rye, barley, and the like, also can be employed as filler materials. Often, certain amounts of Burley or Maryland tobaccos, or the so called rare or specialty tobaccos can be employed as blend components also. The tobacco materials can be employed in a processed form (e.g., as volume expanded flue-cured tobacco filler). For example, the tobacco material can be volume expanded using the techniques described in U.S. Pat. No. 3,524,451 to Fredrickson or in U.S. Pat. No. 4,531,529 to White et al. If desired the preferred flue-cured tobacco material can be blended with processed tobacco stems, reconstituted tobacco materials (e.g., preferably those reconstituted tobacco materials made principally from flue-cured tobacco and/or Oriental tobaccos), or tobacco substitute materials. If desired, the preferred tobacco materials can be blended with varying amounts of carbonized and/or pyrolyzed materials.

The smokable materials generally are employed in the form of cut filler as is common in conventional cigarette manufacture. For example, the smokable filler material can be employed in the form of shreds or strands cut into widths ranging from about 1/25 inch to about 1/60 inch, preferably from about 1/30 inch to about 1/40 inch. Generally, such pieces have lengths which range from about 0.25 inch to about 3 inches.

The filler material most desirably is composed of more than about 70 weight percent flue-cured tobacco material, and more preferably more than about 75 weight percent flue-cured tobacco material. Oftentimes in instances when the flue-cured tobacco cut filler is highly volume expanded, a majority of the volume of the filler material within a blend is occupied by the volume expanded flue-cured tobacco material (e.g., more than about 80 percent, and frequently more than 90 percent of the volume of the filler is occupied by the flue-cured tobacco material).

An example of a preferred filler material includes about 10 to about 20 percent by weight of Oriental tobacco material, about 5 to about 10 percent by weight of Maryland tobacco material, and from about 70 to about 90 percent by weight of flue-cured tobacco material. Preferred filler materials include a relatively large proportion of volume expanded flue-cured tobacco material. Such volume expanded tobacco materials aid in providing a tobacco rod having a low packing density.

As used herein, "packing density" means the weight of the filler material which occupies a unit volume within the smokable rod. For articles of this invention, the packing density generally ranges from about 100 $mg/cm^3$ to about 250 $mg/cm^3$, more typically from about 100 $mg/cm^3$ to about 200 $mg/cm^3$, and in certain instances from about 130 $mg/cm^3$ to about 180 $mg/cm^3$.

Flavorants can be incorporated into the cigarettes. For example, the filler materials can be employed with or without casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives such as organic acids can be incorporated into the cigarette as additives to the cut filler. In particular, levulinic acid, nicotine levulinate, or a mixture of levulinic acid and nicotine can be incorporated into the cigarette. For example, the levulinic acid, nicotine levulinate or levulinic acid/nicotine mixture can be added to the cut filler in amounts which typically range from about 1 to about 10 percent, based on the weight of the cut filler. See, European Patent Application No. 283672.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the smoking article can be varied in order to control the performance characteristics of the smoking article.

Preferably, the air dilution means is positioned along the length of the cigarette at a point along the filter which is at a maximum distance from the extreme mouthend of the article. The maximum distance is dictated by factors such as manufacturing constraints associated with the type of tipping employed and the cigarette manufacturing apparatus and process. For example, for a filter element having a 27 mm length, the maximum distance may range from about 23 mm to about 26 mm from the extreme mouthend of the filter element. The positioning of the air dilution vents a maximum distance from the extreme mouthend of the article allows for providing a maximum ventilation level for a given "tar" yield and maximum cigarette pressure drop for a given filter element and tobacco rod combination.

As used herein, the term "air dilution" is the ratio (generally expressed as a percentage) of the volume of air drawn through the air dilution means to the total volume of air and smoke drawn through the smoking article and exiting the extreme mouthend portion of the smoking article. For air diluted or ventilated smoking articles of this invention, the amount of air dilution can vary. Generally, the amount of air dilution for a cigarette is greater than about 30 percent, preferably greater than about 40 percent, more preferably greater than about 50 percent. Typically, for cigarettes of relatively small circumference (i.e., about 21 mm or less) the air dilution can be somewhat less than that of cigarettes of larger circumference. The upper limit of air dilution for a cigarette typically is less than about 85 percent, more frequently less than about 75 percent.

As used herein, the term "pressure drop" in referring to the smoking article is meant that difference between atmospheric pressure at the extreme mouthend point of the smoking article, as measured at a given flow rate through the smoking article. Typical pressure drop values for cigarettes of this invention are greater that about 40 mm, more frequently greater than about 50 mm of water pressure drop at 17.5 ml/sec of air flow rate.

Most desirable wrapping materials for the tobacco rod have relatively low inherent permeabilities and relatively high net permeabilities. By the term "inherent permeability" is meant the air flow porosity of the wrapping material itself. Typically, wrapping materials having low inherent permeabilities have porosities which are less than about 45 CORESTA units, preferably less than about 30 CORESTA units and more preferably about 15 CORESTA units or less. By the term "net permeability" is meant the air flow porosity of the wrapping material as used in manufacturing the tobacco rod. Typically, the air permeability is provided to the wrapping material using micro laser, mechanical or electrostatic perforation techniques. During micro laser and electrostatic perforation operations, it is most desirable that care be taken to maintain the desired color and opacity of the paper. For example, it is most desirable to minimize or avoid an unsightly "browning" or singeing of the paper.

Preferred wrapping materials are paper wrapping materials which contain from about 10 to about 45 percent, more preferably about 12 to about 35 percent, by weight of magnesium oxide and/or magnesium hydroxide. Often, desirable paper wrapping materials contain more than about 15 percent by weight of magnesium oxide and/or magnesium hydroxide. Examples of suitable materials are described in U.S. Pat. Nos. 4,231,377 to Cline et al; 4,420,002 to Cline and 4,450,847 to Owens. The preferred wrapping materials also contain other water insoluble fillers such as calcium carbonate. The preferred papers also contain flax fibers, wood pulp, or other cellulosic material to provide a cellulosic base web.

The wrapping materials are processed in order to have a relatively high net permeabilities. For example, wrapping materials having low inherent permeabilities can be perforated using conventional electrostatic perforating techniques (e.g., to provide individual perforations comparable in size to conventional electrostatically provided perforations) to obtain a wrapping material having a porosity of from about 50 to about 200 CORESTA units, preferably from about 80 to about 140 CORESTA units, more preferably from about 90 to about 120 CORESTA units.

The sizes of the individual perforations which provide for the high net permeabilities to the cigarette paper wrap generally are such that the perforations are larger than the pores which are present in the naturally occurring paper wrap (i.e., which provide the inherent permeability to the paper). For aesthetics purposes, the individual perforations preferably are small enough to not be unsightly. For example, the perforations are not particularly noticable, and in most instances are barely visible to the naked eye.

The cigarette paper wrap includes at least one water soluble alkali metal salt and at least one water soluble alkali earth metal salt. Examples of water soluble alkali metal salts include sodium acetate, potassium acetate, sodium potassium tartrate, potassium nitrate, potassium citrate, potassium chlorate, sodium succinate, monosodium glutamate, potassium succinate, sodium malate, potassium propionate, potassium succinate, sodium succinate, potassium formates and the like, as well as mixtures thereof. Examples of water soluble alkali earth metal salts include magnesium sulfate, calcium nitrate, calcium acetate, calcium chloride, calcium glutamate, calcium gluconate, and the like, as well as mixtures thereof. Also useful are salts such as magnesium potassium hydrogen carbonate.

The manner in which the water soluble alkali metal and alkali earth metal salts are incorporated into the paper wrap can vary. The salts can be incorporated into the paper during the manufacturing process. Alternatively, the salts can be incorporated into the paper using size press techniques, painting techniques, or the like. Such techniques will be apparent to the skilled artisan. It is highly preferred that the salts be incorporated into the paper in an essentially uniform manner throughout the paper. The various water soluble salts can be incorporated into the paper simultaneously, or at different processing stages during or after paper manufacture.

The amount of water soluble alkali metal and alkali earth metal salts incorporated into the paper wrap is such that the amount of those salts provide at least about 20 mg water soluble alkali metal and alkali earth metal ions per gram of dry base web. The amount of water soluble alkali metal and alkali earth metal salts incorporated into the paper wrap normally is such that those salts provide at least about 30 mg, and frequently at least about 40 mg, water soluble alkali metal and alkali earth metal ions per gram of dry base web. The amount of water soluble alkali metal and alkali earth metal salts incorporated into the paper wrap normally is such that those salts provide less than about 100 mg, and frequently less than about 80 mg, water soluble alkali metal and alkali earth metal ions per gram of dry base web.

The amounts of alkali metal salts and alkali earth metal salts relative to one another can vary. Normally, each type of salt provides to the paper wrap into which it is incorporated at least about 5 mg, preferably at least about 10 mg, of water soluble cation per gram of dry base web. However, for certain paper wraps, it is desirable to incorporate in the paper wrap less than about 20 mg water soluble alkali metal ion per gram of dry base web. A preferred paper wrap having flax fibers, calcium carbonate filler and magnesium hydroxide filler often can incorporate (i) at least one water soluble alkali metal salt to provide about 10 mg to about 20 mg of alkali metal ions per gram of dry base web; and (ii) at least one water soluble alkali earth metal salt in an amount sufficient to provide a paper wrap having a total of about 35 mg to about 60 mg of water soluble alkali metal and alkali earth metal ions per gram of dry base web.

Cigarette paper wrappers also can incorporate other additives, such as sodium borate and/or boric acid. Typically, additives such as sodium borate and/or boric acid are incorporated into the paper wrapper in amounts less than about 0.5 percent based on the weight of the dry base web.

Cigarettes of this invention generally deliver FTC "tar" in the range from about 2 to about 10 mg/ cigarette; and carbon monoxide in the range lower than that of a cigarette of a comparable "tar" level. The cigarettes yield relatively low levels of mainstream gaseous components such as carbon monoxide and nitrogen oxides. For example, typical FTC "tar" to FTC carbon monoxide ratios are less than about 1.1, frequently less than about 1, in certain instances less than about 0.8.

Cigarettes of this invention generally deliver less smoke due to the relatively low total consumable tobacco weight provided by the expanded tobaccos, expanded grains and/or carbonized materials. By the term "less smoke" in referring to a cigarette of this invention is the weight loss during FTC smoking conditions is lower than conventional cigarettes of similar "tar" delivery and configuration. Weight loss is measured by collecting the ash and butt of the cigarette after smoking, and comparing that weight to the total weight of the cigarette before smoking. Total weight loss of a cigarette during smoking is directly related to the total smoke emitted by the cigarette. Cigarettes of this invention exhibit a weight loss which is typically about 15 percent less, and occasionally as much as about 25 percent less than conventional cigarettes of comparable FTC "tar" delivery and configuration.

Preferred cigarettes of this invention produce less visible sidestream smoke than conventional cigarettes of comparable configuration when evaluated using the method described by Baker at col. 3, lines 38–49 of U.S. Pat. No. 4,624,268. The reduction in visible sidestream smoke of cigarettes of this invention is such that sidestream smoke emitted by cigarettes of this invention frequently can be as much as 50 percent of that of conventional cigarettes of comparable FTC "tar" delivery and configuration. By the term "configuration" in referring to a cigarette is meant the circumference, tobacco rod length and filter element length. In addition, in terms of sensory perception, the sidestream smoke of preferred cigarettes of this invention can be characterized as less irritating than that of conventional cigarettes of comparable FTC "tar" delivery and configuration when evaluated using the test methodology described by G. A. Ryan, *40th Tobacco Chemists, Research Conference*(October, 1986).

The following examples are provided in order to further illustrate the invention but should not be construed as limiting the scope thereof. Unless otherwise noted, all parts and percentages are by weight.

EXAMPLE 1

Cigarettes having lengths of about 99 mm and circumferences of about 24.85 mm have tobacco rod lengths of 68 mm and filter element lengths of 31 mm. The tobacco rod includes a charge of tobacco cut filler contained in a circumscribing cigarette paper wrap. The filler material employed in providing the tobacco rod is in the form of strands cut at about 32 cuts per inch. The initial filler material includes a blend of about 77 percent flue-cured tobacco which has been volume expanded to about twice its original volume, about 6 percent Maryland tobacco and about 17 percent Oriental tobacco. The blend had a water and glycerine casing applied thereto.

The paper wrap is sold commercially as Ecusta Experimental No. TOD 03990 by Ecusta Corp. The paper wrap is a heavy weight sheet, low visible sidestream paper. The base sheet contains about 15 percent calcium carbonate, about 25 percent magnesium hydroxide and about 60 percent flax fiber. The paper has an inherent permeability of 12 CORESTA units and a basis weight of 47 g/m$^2$. The paper includes about 6 mg sodium ions per gram of base sheet and about 11 mg potassium ions per gram of dry base sheet. The sodium and potassium ions are provided as sodium acetate and potassium acetate. The paper is electrostatically perforated in order to yield a net permeability of 100 to 130 CORESTA units. The general perforation pattern is shown in FIG. 2. The individual perforations each have a size comparable to conventional electrostatic perforations in conventional cigarette wrap, and are positioned with about 1 to about 10 perforations/mm essentially linearly in the longitudinal direction such that the lines of perforations are positioned about 1 mm to about 3 mm apart.

The low efficiency filter element is manufactured using conventional cigarette filter making technology from cellulose acetate tow (8 denier per filament, 40,000 total denier) and circumscribing air permeable paper plug wrap.

The tobacco rod and filter element have similar circumferences, are aligned in an abutting, end-to-end relationship, and are secured together using tipping paper. The tipping paper is adhesively secured to the filter element and the adjacent portion of the tobacco rod. The tipping material circumscribes the length of the filter element and about 3 mm of the length of the tobacco rod. Cigarettes so described are manufactured using a Hauni Protos Cigarette Maker from Hauni-Werke Korber & Co. KG. A ring of mechanically provided perforations thus providing the permeability extends around the periphery of the cigarette about 13 mm from the extreme mouthend thereof. The perforations so provided yield cigarettes with about 32 percent air dilution.

The cigarette weighs 0.926 g and the filler material within the rod has a packing density of 168 mg/cm$^3$.

A 10 percent solution of calcium chloride in distilled water is provided. The solution is painted evenly using a brush over the entire outer surface of the paper wrap of the tobacco rod. The paper wrap is allowed to dry at room temperature. A second application of the solution then is applied to the paper wrap of the tobacco rod. The paper wrap then is allowed to dry at room temperature for 24 hours. Enough solution is applied to the paper wrap to provide an amount of calcium chloride into the paper wrap such that 26 mg of water soluble calcium ions are incorporated into each gram of dry base sheet. Thus, a total of 43 mg of water soluble alkali metal and alkali earth metal ions are incorporated per gram of dry base web.

The cigarette is smoked and delivers a rich tobacco flavor as well as an acceptable draft resistance. The mainstream smoke is not harsh and the cigarette yields desirable smoking satisfaction. Also, the cigarette yields low amounts of visible sidestream smoke. The ash of the cigarette having the water soluble alkali earth metal salt applied to the paper wrap is less flakey than a similar cigarette not treated with such a salt.

What is claimed is:

1. A cigarette comprising a rod of smokable material contained in a circumscribing paper wrapping material, the wrapping material having (i) a cellulosic base web containing a water insoluble inorganic filler, (ii) an amount of water soluble alkali metal salt to provide at least about 5 mg water soluble alkali metal cation per gram of dry base web, (iii) an amount of water soluble alkali earth metal salt to provide at least about 5 mg water soluble alkali earth metal cation per gram of dry base web, and (iv) an amount of said water soluble alkali metal salt and said water soluble alkali earth metal salt to provide at least about 20 mg water soluble alkali metal and alkali earth metal ions per gram of dry base web.

2. The cigarette of claim 1 wherein the amount of water soluble alkali metal salt and water soluble alkali earth metal salt provides to the wrapping material at least about 30 mg water soluble alkali metal and alkali earth metal ions per gram of dry base web.

3. The cigarette of claim 1 wherein the amount of water soluble alkali metal salt and water soluble alkali earth metal salt provides to the wrapping material at least about 40 mg water soluble alkali metal and alkali earth metal ions per gram of dry base web.

4. The cigarette of claim 1, 2 or 3 wherein the amount of water soluble alkali metal salt and water soluble alkali earth metal salt provides to the wrapping material less than about 100 mg water soluble alkali metal and alkali earth metal ions per gram of dry base web.

5. The cigarette of claim 1, 2 or 3 wherein the amount of water soluble alkali metal salt and water soluble alkali earth metal salt provides to the wrapping material less than about 80 mg water soluble alkali metal and alkali earth metal ions per gram of dry base web.

6. The cigarette of claim 1, 2 or 3 wherein the water insoluble inorganic filler of the wrapping material includes calcium carbonate.

7. The cigarette of claim 4 wherein the water insoluble inorganic filler of the wrapping material includes calcium carbonate.

8. The cigarette of claim 1, 2 or 3 wherein the water insoluble inorganic filler of the wrapping material includes magnesium hydroxide.

9. The cigarette of claim 4 wherein the water insoluble inorganic filler of the wrapping material includes magnesium hydroxide.

10. The cigarette of claim 1, 2 or 3 wherein the wrapping material includes more than about 10 mg water soluble alkali metal ion per gram of dry base web.

11. The cigarette of claim 4 wherein the wrapping material includes more than about 10 mg water soluble alkali metal ion per gram of dry base web.

12. The cigarette of claim 1, 2 or 3 wherein the wrapping material includes less than about 20 mg water soluble alkali metal ion per gram of dry base web.

13. The cigarette of claim 4 wherein the wrapping material includes less than about 20 mg water soluble alkali metal ion per gram of dry base web.

14. The cigarette of claim 1, 2 or 3 wherein the wrapping material has an inherent permeability of less than about 45 CORESTA units and a net permeability of greater than 50 CORESTA units.

15. The cigarette of claim 4 wherein the wrapping material has an inherent permeability of less than about 45 CORESTA units and a net permeability of greater than 50 CORESTA units.

16. The cigarette of claim 4 wherein the wrapping material has an inherent permeability of less than about 45 CORESTA units and a net permeability of greater than 50 CORESTA units and wherein the water insoluble inorganic filler of the wrapping material includes calcium carbonate and magnesium hydroxide.

17. The cigarette of claim 4 wherein the wrapping material has an inherent permeability of less than about 45 CORESTA units and a net permeability of greater than 50 CORESTA units and wherein the water insoluble inorganic filler of the wrapping material includes calcium carbonate and magnesium hydroxide.

18. The cigarette of claim 1, 2 or 3 wherein the water soluble alkali earth metal ions of the water soluble alkali earth metal salt include calcium ions.

19. The cigarette of claim 4 wherein the water soluble alkali earth metal ions of the water soluble alkali earth metal salt include calcium ions.

20. The cigarette of claim 1, 2 or 3 wherein the water soluble alkali metal ions of the water soluble alkali metal salt include potassium ions.

21. The cigarette of claim 4 wherein the water soluble alkali metal ions of the water soluble alkali metal salt include potassium ions.

22. The cigarette of claim 1, 2 or 3 wherein the wrapping material includes more than about 10 mg water soluble alkali earth metal ion per gram of dry base web.

23. The cigarette of claim 4 wherein the wrapping material includes more than about 10 mg water soluble alkali earth metal ion per gram of dry base web.

24. The cigarette of claim 1, 2 or 3 wherein the wrapping material (i) includes more than about 10 mg of water soluble alkali metal ion per gram of dry base web, (ii) includes more than about 10 mg of water soluble alkali earth metal per gram of dry base web, and (iii) the water insoluble inorganic filler includes calcium carbonate and magnesium hydroxide.

25. The cigarette of claim 4 wherein the wrapping material (i) includes more than about 10 mg of water soluble alkali metal ion per gram of dry base web, (ii) includes more than about 10 mg of water soluble alkali earth metal per gram of dry base web, and (iii) the water insoluble inorganic filler includes calcium carbonate and magnesium hydroxide.

26. A paper wrapper for a smokable rod of a cigarette, the wrapper comprising a cellulosic base web, an inorganic filler, an amount of water soluble alkali metal salt to provide at least about 5 mg water soluble alkali metal ion per gram of dry base web, an amount of water soluble alkali earth metal salt to provide at least about 5 mg water alkali earth metal ion per gram of dry base web, and an amount of and water soluble alkali metal salt and said water soluble alkali earth metal salt to provide at least 20 mg water soluble alkali metal and alkali earth metal ions per gram of dry base web.

27. The cigarette wrapper of claim 26 wherein the amount of water soluble alkali metal salt and water soluble alkali earth metal salt provides to the wrapping material at least about 30 mg water soluble alkali metal and alkali earth metal ions per gram of dry base web.

28. The cigarette wrapper of claim 26 wherein the amount of water soluble alkali metal salt and water soluble alkali earth metal salt provides to the wrapping material at least about 40 mg water soluble alkali metal and alkali earth metal ions per gram of dry base web.

29. The cigarette wrapper of claim 26 wherein the amount of water soluble alkali metal salt and water soluble alkali earth metal salt provides to the wrapping material less than about 100 mg water soluble alkali metal and alkali earth metal ions per gram of dry base web.

30. The cigarette wrapper of claim 29 comprising more than about 10 mg water soluble alkali metal ion per gram of dry base web, more than about 10 mg of water soluble alkali earth metal per gram of dry base web, and the water insoluble inorganic filler includes calcium carbonate and magnesium hydroxide.

* * * * *